US012618641B1

(12) United States Patent
Trudeau et al.

(10) Patent No.: US 12,618,641 B1
(45) Date of Patent: May 5, 2026

(54) FIREARM SHOULDER STOCK ASSEMBLY

(71) Applicant: TruArmor a division of Clear-Armor, LLC., Grayslake, IL (US)

(72) Inventors: David Anthony Trudeau, Grayslake, IL (US); Adam Eyad Khoury, Gurnee, IL (US)

(73) Assignee: TRUARMOR A DIVISION OF CLEAR-ARMOR, LLC, Grayslake, IL (US)

( * ) Notice: Subject to any disclaimer, the term of this patent is extended or adjusted under 35 U.S.C. 154(b) by 0 days.

(21) Appl. No.: 18/934,438

(22) Filed: Nov. 1, 2024

(51) Int. Cl.
*F41C 23/22* (2006.01)

(52) U.S. Cl.
CPC ..... *F41C 23/22* (2013.01)

(58) Field of Classification Search
CPC .. F41C 23/22; F41C 27/00; F41A 9/61; F41A 9/68; F41A 17/38
See application file for complete search history.

(56) References Cited

U.S. PATENT DOCUMENTS

| | | | | |
|---|---|---|---|---|
| 931,766 | A * | 8/1909 | Kennedy | F41C 23/16 42/71.01 |
| 939,707 | A * | 11/1909 | Kennedy | F41C 23/16 42/71.01 |
| 4,115,943 | A * | 9/1978 | Musgrave | F42B 39/02 42/71.01 |
| 4,944,109 | A | 7/1990 | Zedrosser | |
| 5,225,613 | A * | 7/1993 | Claridge | F41C 23/22 42/74 |
| 5,813,157 | A | 9/1998 | Scott | |
| 6,829,855 | B2 | 12/2004 | Seifert | |
| 7,503,137 | B2 | 3/2009 | Filicietti | |
| 7,805,873 | B2 | 10/2010 | Bentley | |
| 8,327,568 | B1 | 12/2012 | Lavergne | |
| 9,551,549 | B1 | 1/2017 | Chvala | |
| 9,581,411 | B2 | 2/2017 | Zusman | |
| 9,664,478 | B2 | 5/2017 | Robinson | |
| 10,161,713 | B1 * | 12/2018 | Goldense | F41A 17/02 |
| 10,371,475 | B2 | 8/2019 | Cook | |
| 10,895,428 | B2 | 1/2021 | Sessions | |
| 11,150,048 | B1 * | 10/2021 | Stephens | F41C 23/22 |
| 11,226,170 | B2 | 1/2022 | Lynch | |

(Continued)

FOREIGN PATENT DOCUMENTS

| | | |
|---|---|---|
| CH | 580269 | 9/1976 |
| WO | 2008097308 | 8/2008 |

*Primary Examiner* — Benjamin P Lee
(74) *Attorney, Agent, or Firm* — Kirk L. Deheck; Boyle Fredrickson, S.C.

(57) ABSTRACT

An adjustable firearm butt stock that is constructed to be secured to a rearward facing end of a firearm receiver assembly. The butt stock defines a plurality of magazine wells that are offset from one another along a longitudinal axis of the stock. Each magazine well opens in a generally downward facing direction and is constructed to removeably cooperate with cartridge magazines that removeable cooperate with the receiver magazine well associated with operation of an underlying firearm. The stock includes discrete magazine catches associated with each of the respective wells and which are operable to selectively secure and/or effectuate storage and/or removal of discrete cartridge magazines from a respective one of the first and second magazine wells defined by the butt stock.

20 Claims, 7 Drawing Sheets

(56) References Cited

U.S. PATENT DOCUMENTS

| | | | | |
|---|---|---|---|---|
| 11,892,268 | B1 * | 2/2024 | Coombs | F41C 23/08 |
| 12,203,726 | B2 * | 1/2025 | Dubois | F41A 17/38 |
| 2007/0261284 | A1 | 11/2007 | Keng | |
| 2011/0099872 | A1 | 5/2011 | Bentley | |
| 2011/0239514 | A1 | 10/2011 | Godard | |
| 2012/0174455 | A1 | 7/2012 | Edelman | |
| 2015/0276343 | A1 * | 10/2015 | Zusman | F41C 23/22<br>42/71.01 |
| 2016/0097613 | A1 | 4/2016 | Lamb | |
| 2018/0216904 | A1 | 8/2018 | Noonan | |
| 2019/0049213 | A1 * | 2/2019 | Yang | F41C 23/14 |
| 2024/0151495 | A1 | 5/2024 | Barwin | |

* cited by examiner

FIREARM SHOULDER STOCK ASSEMBLY

BACKGROUND OF THE INVENTION

The present invention relates generally to firearms and, more particularly, to a firearm shoulder or butt stock assembly that is constructed to selectively secure additional cartridge magazines to an underlying firearm.

Many firearms are constructed to removably cooperate with a cartridge magazine that can be selectively engaged with the firearm receiver assembly are which are constructed to cooperate with the firing mechanism of the firearm to sequentially deliver discrete rounds of ammunition to the chamber of the firearm. Whereas some such firearms are constructed for manual operation of the underlying bolt to effectuate cyclic introduction of discrete cartridges to the firing chamber and extraction of spent casing from the firing chamber, other firearms are configured to operate in an automatic or semi-automatic modality. As commonly understood, during semi-automatic operation of such firearms, a trigger actuation is required to effectuate a discharge of an initial round of ammunition associated with the firing chamber, automatic ejection the casing associated with a recently discharged round of ammunition, and automatic introduction of a subsequent round of ammunition to the firing chamber when available. When configured for fully automatic operation, multiple rounds of ammunition can be discharged with each trigger actuation when additional ammunition is available.

Ammunition is communicated to the action of the firearm by a magazine that is engaged with a magazine well defined by the receiver assembly, or lower receiver, of the underlying firearm. Many firearms are constructed to support a cartridge or ammunition magazine at a location forward of the trigger and trigger guard assembly such that the magazines can be selectively engaged and disengaged from the receiver via operation of a catch assembly and generally substantially vertical and/or forward/rearward and predominantly vertical translation of the magazine relative to the underlying firearm. Such configurations expedite the removal and association of discrete magazines with the receiver assembly of the firearm in a manner that is both intuitive and does not overly detract from a shooters ability to maintain a visual inspection of an intended target.

In an effort to increase the duration associated with operation of an underlying firearm, others provide various magazine configurations that are simply larger magazines that are constructed to accommodate more discrete rounds of ammunition. Such approaches are not without their respective drawbacks. Magazines having capacities of 5-100 rounds of ammunition are available but 15-30 round magazines are more commonly employed. As is commonly understood, the capacity of discrete magazines is a function of both the longitudinal length of the discrete magazine as well as the size of the discrete cartridges associated with a respective caliber of the underlying firearm. While exchanging a five round magazine for a 100 round magazine substantially increases the operational duration of the underlying firearm, doing so substantially effects the balance of the firearm and greatly effects the footprint of the firearm when such larger capacity magazines are engaged therewith. Many skilled and/or professional firearm users are dissuaded from such approaches as being overly detrimental to desired firearm operation and accuracy. Altering configurations from five rounds of ammunition to 100 rounds of ammunition being oriented forward of the trigger group of a firearm also substantially impacts the user's maneuverability and exacerbates fatigue associated with use of the underlying firearm. Further still, such larger capacity magazines further detract from storage and transport of the firearms and can negate cooperation of the underlying firearm with rifle rests and storage racks without removal or dissociation of the underlying magazine.

Still others provide firearm stock configurations wherein the stock is constructed to support supplement ammunition. Some such constructions simply support discrete rounds of ammunition intended to be individually delivered to the firearm action. Still others provide firearm stocks that are constructed to support supplemental ammunition magazines. Unfortunately, such approaches are not without their respective drawbacks. Many such configurations include a supplemental door or cover that is constructed to enclose the discrete magazines within an enclosed compartment of the stock.

Still others require dissociation of the firearm stock from the shoulder of the shooter to effectuate the removal of supplemental magazines from the stock assembly. Such requirements detract from the user's ability to maintain visual association of the firearm with an intended target and require considerable movement of the bore of the firearm to off-target orientations to effectuate the operation of removal of a spent magazine from the receiver of the firearm, removal of a supplemental magazine from the stock storage location, association with the spent magazine with the stock storage location, and subsequent association of the supplemental magazine with the magazine well defined by the firearm receiver group to effectuate continued operation of the underlying firearm. Such exaggerated movements of the user and the firearm, particularly during tactical operations, can detract from user's ability to remain hidden and delays the user's ability to defend themselves and/or others. Such short comings have led to such approaches having not gained wide acceptability by personnel associated with police and military efforts. Rather, such users remain entrenched to approaches wherein supplemental ammunition magazines are carried by supplemental gear being carried in a vehicle or upon the user rather than the firearm. Unfortunately, such approaches can lead to the undesired and/or unanticipated separation of the user from supplemental ammunition supplies.

Therefore, there is a need for an approach to supplemental ammunition transportation wherein the supplemental ammunition can be transported upon the firearm with which it is usable, does so in a manner that improves the ergonomics associated with transport of the supplemental ammunition and operability of the underlying firearm, does not interfere with the customary usage and/or storage of the underlying firearm, mitigates separation of the firearm from the supplemental ammunition supplies, and which can be expediently and intuitively associated with the firearm when necessary or desired.

SUMMARY OF THE INVENTION

The present invention discloses a firearm shoulder or butt stock assembly that resolves one or more of the shortcomings disclosed above. One aspect of the present invention discloses an adjustable firearm butt stock that is constructed to be secured to a rearward facing end of a firearm receiver assembly. The butt stock defines a plurality of magazine wells that are offset from one another along a longitudinal axis of the stock. Each magazine well opens in a generally downward facing direction and is constructed to removeably cooperate with cartridge magazines that removeably cooperate with the receiver magazine well associated with operation of an underlying firearm. The stock includes discrete magazine catches associated with each of the respective wells and which are operable to selectively secure and/or effectuate storage and/or removal of discrete cartridge magazines from a respective one of the first and second magazine wells defined by the butt stock. Firearms equipped with the firearm stock assembly of the present aspect are constructed to support three discrete cartridge magazines wherein at least two magazines are located rearward of the trigger group and oriented such that similar translations of the magazine associated with the firearm receiver assembly are employed to effectuate removal and placement of the discrete supplement cartridge magazines from the shoulder stock assembly.

Another aspect of the present invention discloses a firearm shoulder stock assembly that is defined by a shoulder stock body constructed to be connected to a firearm receiver such that the shoulder stock body extends rearward from the firearm receiver when the shoulder stock body is connected thereto. A first magazine well is formed in a downward facing surface of the shoulder stock body between a forward facing end and a rearward facing end thereof. A second magazine well is also formed in the downward facing surface of the shoulder stock body between the forward facing end and the rearward facing end of the shoulder stock body such that the second magazine well being is offset in a longitudinal direction along the shoulder stock body from the first magazine well. Each of the first magazine well and the second magazine well are shaped to removeably cooperate with a cartridge magazine and such that the first magazine well and the second magazine well are aligned with a receiver magazine well defined by a firearm when the shoulder stock body is connected thereto.

A further aspect of the present invention discloses a firearm butt stock assembly that includes a stock body and a first magazine well formed in a downward facing surface of the stock body. A second magazine well is also formed in the downward facing surface of the stock body such that the first magazine well and the second magazine well are aligned along a longitudinal centerline of the stock body and shaped to slideably receive respective cartridge magazines and such that the first magazine well and second magazine well are aligned with a receiver magazine well when the stock body is connected to a firearm.

Yet another aspect of the present invention discloses a method of forming a firearm shoulder stock. The method includes forming a stock body that is constructed to be connected to a firearm receiver assembly. A first magazine well and a second magazine well are each formed in the stock body such that the first magazine well and the second magazine well are offset from one another relative to a longitudinal axis of the stock body and such that the first magazine well and the second magazine well open in a common direction with respect to a receiver magazine well defined by a firearm receiver assembly when the stock body is connected thereto.

These and other features, objects, and aspects of the present invention will be better appreciated and understood when considered in conjunction with the following detailed description and the accompanying drawings. It should be understood, however, that the following description, while indicating representative preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention will become more readily apparent by referring to the exemplary, and therefore non-limiting, embodiments illustrated in the drawings accompanying and forming a part of this specification, wherein like reference numerals designate the same elements in the several views.

In the drawings.

DETAILED DESCRIPTION

The present invention and the various features and advantageous details thereof are explained more fully with reference to the non-limiting embodiments described in detail in the following description.

Figure 1:
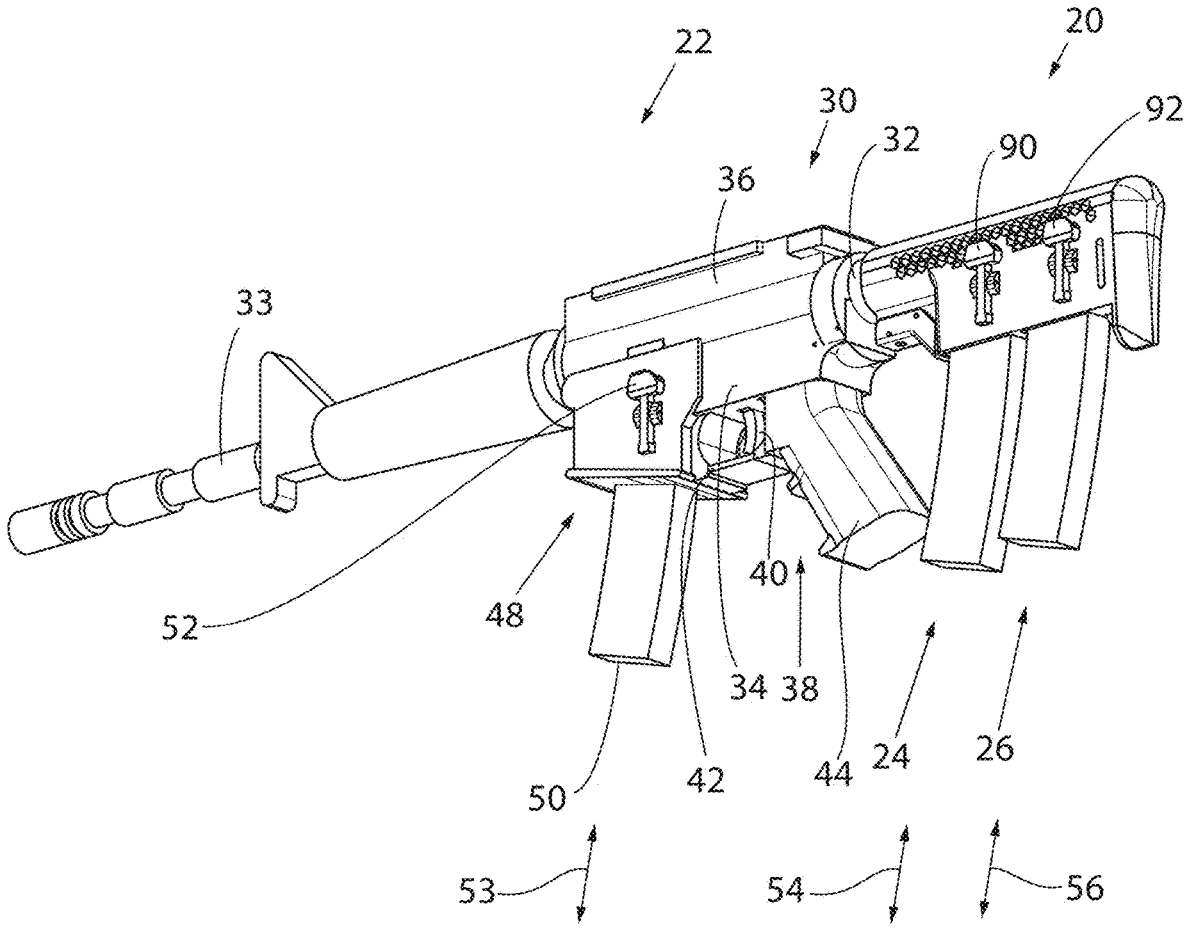
FIG. 1 is a rear lower perspective view of a firearm shoulder or butt stock assembly according to the present invention attached to an underlying firearm assembly.

FIG. 1 shows a butt or shoulder stock assembly 20 according to the present invention attached to an exemplary firearm assembly 22. It is appreciated that firearm assembly 22 can be provided in various calibers as well as various sighting and/or support accessories as well as being operable in various methodologies including single fire as well as semi-automatic and fully automatic operational methodologies wherein the discrete methodologies each include an action wherein discrete rounds of ammunition are delivered to the firing chamber of the firearm via cyclic operation of a bolt associated with the underlying firearm and wherein discrete rounds of ammunition can be delivered to the action via a cartridge magazine or magazine that removably cooperates with a receiver assembly or receiver of the underlying firearm.

Whereas only ammunition associated with the receiver assembly of the underlying firearm may be discharged at any given time, stock assembly 20 is constructed to support a respective first supplemental cartridge magazine 24 and a respective second supplemental cartridge magazine 26 that may be sequentially delivered to a receiver assembly of the underlying firearm. As alluded to above, firearm assembly 22 is generally defined by a receiver assembly 30 having a buffer tube 32 that extends rearward therefrom and a barrel 33 that extends forward therefrom. Receiver assembly 30 generally supports the action associated with operation of firearm assembly 22. Receiver assembly 30 may be provided in various configurations such as those including a lower receiver 34, an upper receiver 36, and a trigger assembly 38 engaged therewith.

Trigger assembly 38 includes a trigger 40 associated with operation of the firing pin of the action of the underlying firearm. A trigger guard 42 is oriented forward of trigger 40 whereas a grip 44 is oriented rearward thereof. Generally forward of trigger guard 42 and/or integrally formed therewith, receiver assembly 30 defines a magazine well 48 that is constructed to removably cooperate with an ammunition magazine 50 associated with delivering respective cartridges as disclosed below to the action of the underlying firearm. A receiver magazine catch 52 is supported by receiver assembly 30 of firearm assembly 22 and effectuates the selective engagement and disengagement of receiver cartridge magazine 50 relative to an underlying firearm assembly 22. Although not shown, it is further appreciated that receiver assembly 30 may include various other control mechanism such as a fire selector switch, a safety switch, and may be configured for operation of the discrete user selection switches and/or buttons in a righthand configuration, a lefthand configuration, and/or an ambidextrously operable interface.

Regardless of the underlying configuration of the various controls associated with user interaction with firearm receiver assembly 30, each of magazines 24, 26, 50 are selectively movable in generally upward and downward respective directions, indicated by arrows 52, 54, 56 to effectuate the selective engagement and/or disengagement of respective cartridge magazines 24, 26, 50 from the underlying stock assembly 20 and firearm assembly 22 to facilitate the various positioning of respective cartridge magazines 24, 26, 50 with either of receiver assembly 30 and/or the magazine storage locations defined by stock assembly 20. That is, each of cartridge magazines 24, 26, 50 are constructed to interchangeably cooperate with shoulder stock assembly 20 and/or receiver magazine well 48 when desired or preferred.

Figure 2:
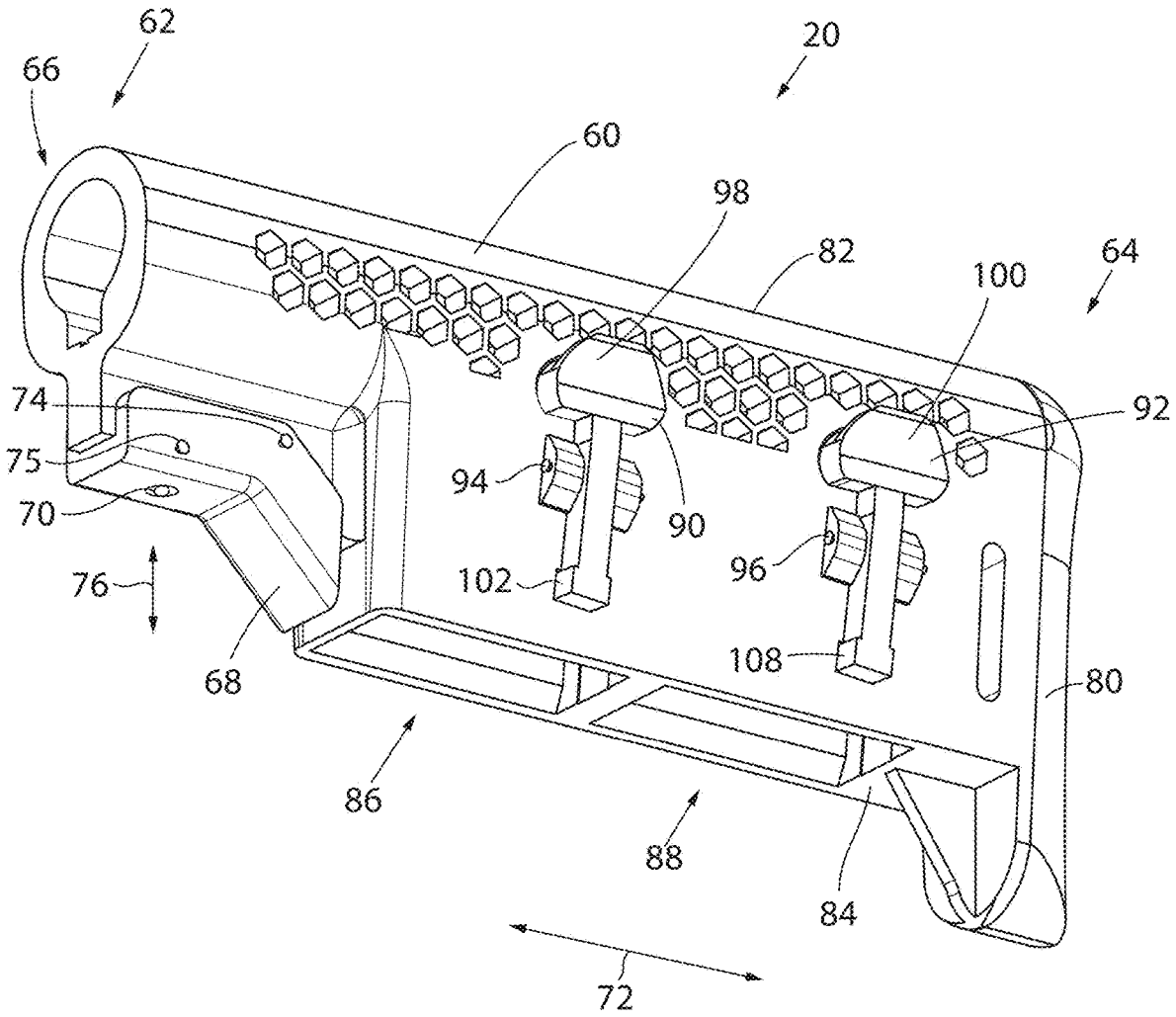
FIG. 2 is forward lower perspective view of the firearm shoulder stock assembly according to the present invention and removed from the underlying firearm shown in FIG. 1.

As shown in FIG. 2, shoulder stock assembly 20 is generally defined by a firearm shoulder stock body or simply stock body 60 that extends in a longitudinal direction between a forward or forward facing end 62 and a rearward end 64 thereof. A cavity 66 is formed in the forward facing end 62 of stock body 60 and is constructed to slideably cooperate with buffer tube 32 (FIG. 1) associated with receiver assembly 30 of firearm assembly 22. Buffer tube 32 has a generally industry accepted shape and construction such that stock assembly 20 of the present invention is constructed to cooperate with original equipment manufacturer firearm constructions via simple replacement of OEM shoulder stocks that do not provide supplemental magazine storage as disclosed by the present invention.

As disclosed further below, a latch 68 is connected to stock body 60 and connected to a catch pin 70 that selectively engages buffer tube 32 when stock assembly 20 is engaged with firearm assembly 22. Latch 68 is connected to stock body 60 via a pivot pin 74 such that latch 68 is rendered pivotable relative to stock body 60. A pin 75 passes through latch 68 such that opposing ends of pin 75 are supported by latch and a middle portion of pin 75 cooperates with a passage 79 defined by catch pin 70 such that rotation of latch 68 relative to stock body 60 provides axial displacement, indicated by arrow 76, of catch pin 70 to provide selective disengagement of catch pin 70 from buffer tube 32 and thereby selectively longitudinal displacement of stock assembly 20 relative to receiver assembly 30. Such a consideration allows adjustment of distance between the rear of the stock assembly 20 and the trigger assembly 38 to accommodate the preferences of discrete users.

An optional pad 80 is disposed at a rearward end 64 of stock body 60 and configured to engage the shoulder of the user during operation of firearm assembly 22. Stock body 60 is further defined by an upwardly directed surface or edge 82 and a lower or downward directed surface 84 between forward end 62 and rearward end 64 of stock body 60. A first magazine well 86 and a second magazine well 88 are defined by stock body 60 such that the discrete magazine wells 86, 88 are formed in downward facing surface 84 thereof. That is, discrete magazine wells 86, 88 face in a common direction with receiver magazine well 48. First magazine well 86 and second magazine well 88 are longitudinally offset from one another along the longitudinal axis 72 of stock body 60 so as to not interfere with one another and/or the discrete magazines associated therewith. A first magazine release or catch 90 and a second magazine release or catch 92 are each pivotally connected to stock body 60 via respective pivot pins 94, 96 such that respective magazine catch 90, 92 are independently pivotal relative thereto and allow individual placement and/or extraction of the discrete magazines 24, 26 from the respective magazine wells 86, 88. Although shown as being associated with what can be considered the left hand side of stock assembly 20 such that respective catches 94, 96 are generally considered as being left-hand operable, it is further appreciated that respective catches 94, 96 could be provided in what are considered right hand operable configurations and/or an ambidextrously operable configuration wherein the paddle associated with manipulation of the magazine engaging projections are associated with the right hand side of stock assembly 20 and/or wherein corresponding paddles are associated with each of the opposite lateral sides of stock assembly 20. It is further appreciated that, when associated with the right hand side of stock assembly 20, such paddle and catch assemblies may include discrete linkage members that extend laterally through stock assembly 20 without interfering with any magazines that may be associated therewith and/or slideable association of buffer tube 32 with buffer tube cavity 66 in the manners described herein, respectively.

Figure 3:
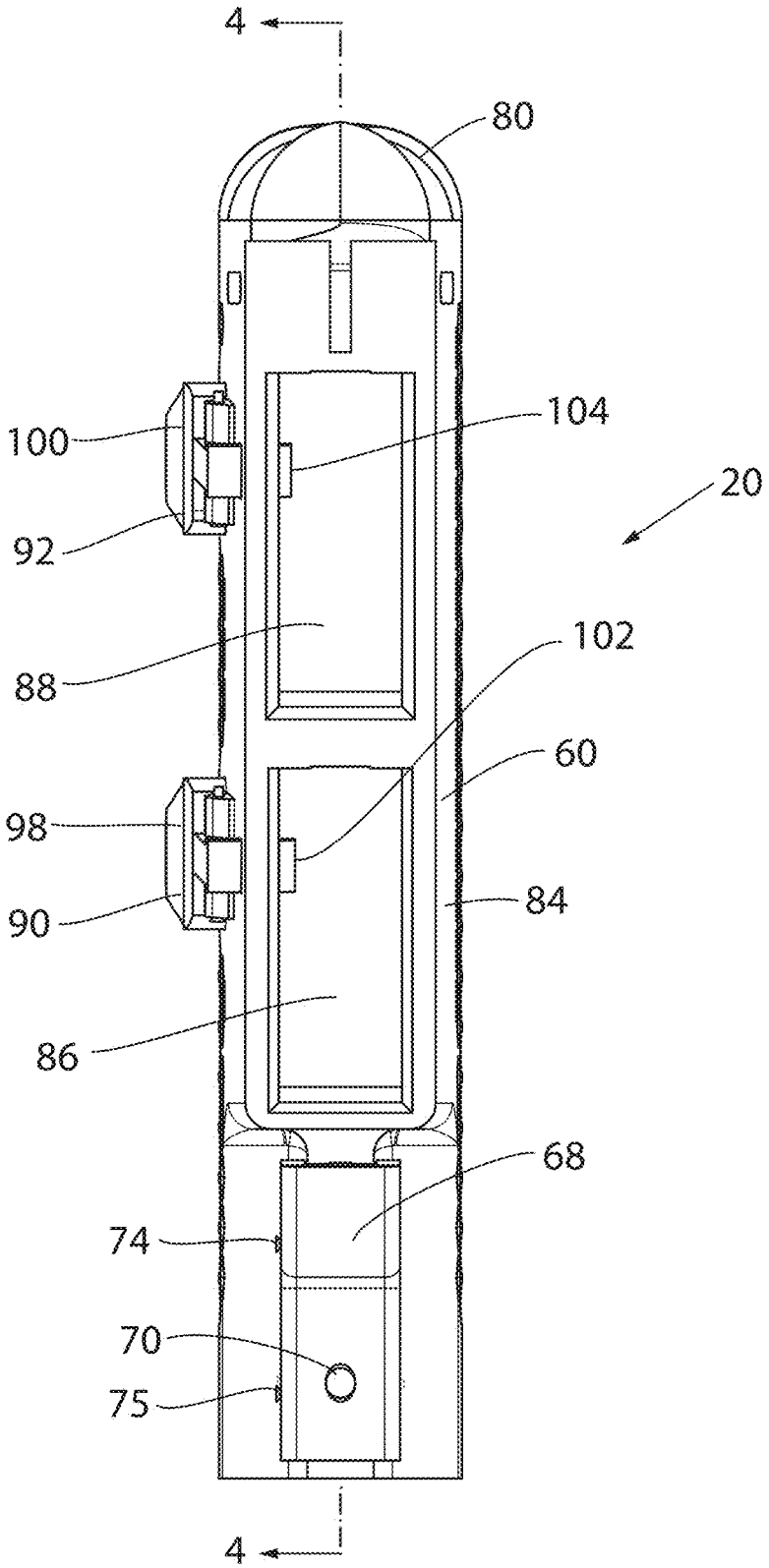
FIG. 3 is a bottom plan view of the firearm shoulder stock assembly shown in FIG. 2.
Figure 4:
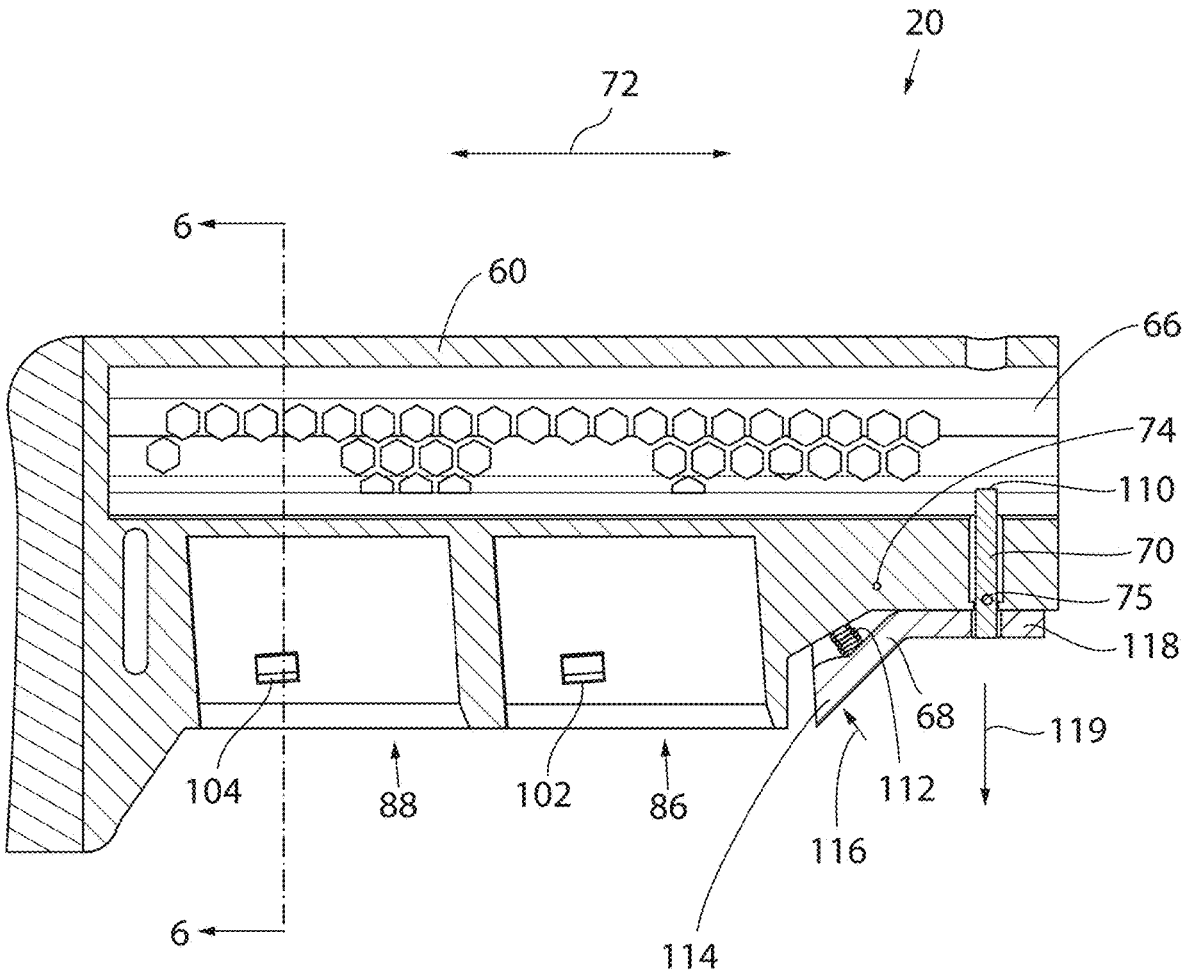
FIG. 4 is a longitudinal cross section elevation view of the shoulder stock assembly taken along line 4-4 shown in FIG. 3.

As shown in FIGS. 3 and 4, magazine catch 90, 92 each include a paddle 98, 100 and a projection 102, 104 that are disposed at generally opposite ends of magazine catches 90, 92 relative to respective pivot pins 94, 96. User interaction with discrete paddles 98, 100 allow selective disengagement of respective projections 102, 104 from respective cartridge magazines that are associated with respective magazine wells 86, 88 of stock body 60. Such a construction allows respective magazines that are engaged with respective magazine wells 86, 88 of stock body 60 to be individually engaged and/or disengaged from the corresponding magazine well 86. 88 without alteration of the engagement associated with a discrete magazine associated with the other respective magazine well 86. 88.

Each of stock magazine wells 86, 88 and firearm receiver magazine well 48 and magazine catches 90, 92 and receiver magazine catch 52 are similarly shaped and constructed so as to provide a generally intuitive user interaction with discrete magazine catches 52, 98, 100 so as to effectuate the respective operation thereof and disengagement of respective magazines 24, 26, 50 from the respective individual magazine wells 48, 86, 88 during exchanges therebetween. As disclosed further below, each of projections 102, 104 associated with respective magazine releases or catches 90, 92 of stock assembly 20 are constructed to be automatically deflectable upon the introduction of a respective cartridge magazine to the respective magazine well 86, 88 until respective projections 102, 104 engage a corresponding cavity defined by the corresponding magazine to effectuate a secure interaction therebetween and thereby retain the respective magazine relative to the respective magazine well when respective magazines are vertically translated in a generally upward direction relative to the respective magazine wells 86, 88.

Referring to FIG. 4, buffer tube cavity 66 of stock body 60 preferably extends along a majority of the longitudinal length of stock body 60 and is vertically offset from respective magazine cavities or wells 86, 88 such that buffer tube 32 (FIG. 1) does not interfere with the selective engagement and/or disengagement of the respective cartridge magazines with the respective magazine wells 86, 88 of shoulder stock assembly 20 when shoulder stock assembly 20 is engaged with an underlying firearm assembly 22. Pin 70 includes a distal end 110 that extends into selectively overlapping interference with buffer tube cavity 66 and selectively interacts with buffer tube 32 at various discrete locations relative thereto.

A biasing device, such as a spring 112, acts upon latch 68 to bias pin 70 into engagement with buffer tube 32 when secured to the underlying firearm assembly 22. When a user presses upon a handle portion 114 of latch 68, indicated by arrow 116, such interaction overcomes the bias associated with spring 112 as latch 68 rotates about pivot pin 74 such that a forward end 118 of latch 68 translates pin 70 in a generally downward direction, indicated by arrow 119, to retract distal end 110 of pin 70 from the cross-sectional area of buffer tube cavity 66. When retracted, pin 70 no longer interacts with buffer tube thereby allowing slidable cooperation of buffer tube 32 with buffer tube cavity 66 until a desired longitudinal orientation of stock body 60 is attained relative to the underlying firearm assembly 22. When the user releases handle portion 114, pin 70 is biased into engagement with buffer tube 32 thereby retaining the relative longitudinal position of stock assembly 20 relative to buffer tube 32 and thereby an underlying receiver or receiver assembly 30 and firearm assembly 22.

Figure 5:
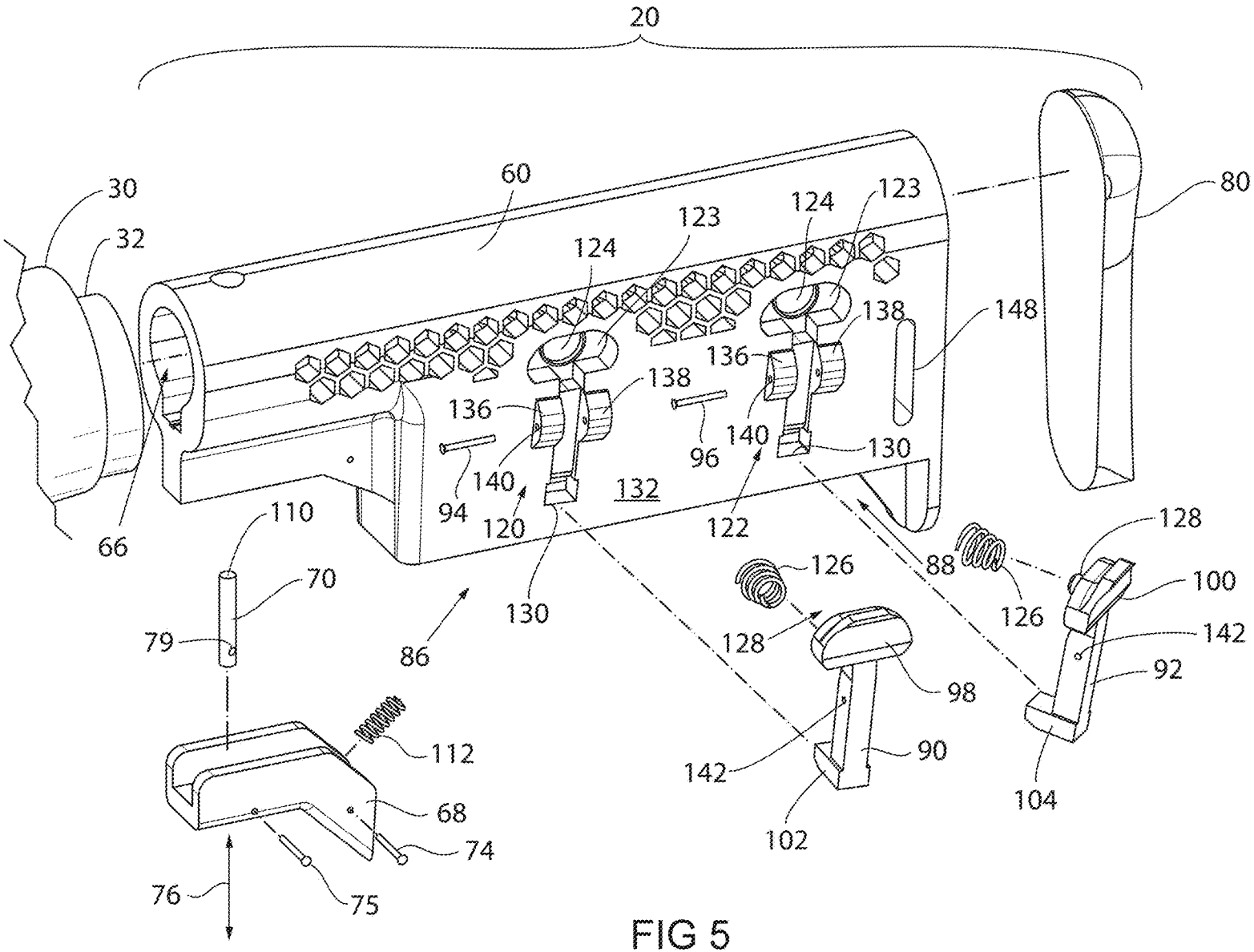
FIG. 5 an exploded perspective view of the shoulder stock assembly shown in FIG. 2; is a cross-sectional view of the projectile resistant assembly of FIG. 4 take along line 5-5.

As shown in FIG. 5, stock body 60 includes a first magazine catch cavity 120 and a second magazine catch cavity 122 associated with supporting respective magazine catches 90, 92 relative thereto. An upper portion 123 of each cavity 120, 122 is shaped to generally cooperate with a respective paddle 98, 100 of respective magazine catches 90, 92. A seat 124 is formed in each upper portion 123 of each cavity 120, 122 and configured to receive a biasing device, such as a spring 126, generally disposed between respective paddle 98, 100 and stock body 60. A post 128 extends in a laterally inboard direction relative to respective paddles 98, 100 and is configured to orient and restrain respective biasing devices 126 between respective paddle 98, 100 and stock body 60 when magazine catches 90, 92 are secured thereto.

A lower end of each of cavities 120, 122 includes a bore 130 that is constructed to facilitate slidable cooperation with projections 102, 104 of magazine catches 90, 92 through a wall 132 of stock body 60 such that respective projections 102, 104 can extend into the respective magazine wells 86, 88 disposed therebehind. Opposing bosses 136, 138 generally flank respective cavities 120, 122 and include bores 140 that are formed therethrough. Each of bores 140 are configured to cooperate with respective pivot pins 94, 96 when respective magazine catches 90, 92 are secured to stock body 60. During assembly, respective magazine catches 90, 92 are oriented relative to respective cavities 120, 122 with respective springs 126 captured between respective posts 128 and seats 124 such that respective pins 94, 96 can pass through respective bores 140 associated with bosses 136; through a corresponding bore 142 associated with respective magazine catches 90, 92; and into the adjacent boss 138 associated with stock body 60 thereby securing respective magazine catches 90, 92 in a pivotable manner to stock body 60. Stock body 60 further includes an option sling opening 148 associated with supporting the sling relative to stock body 60 when desired.

Figure 6:
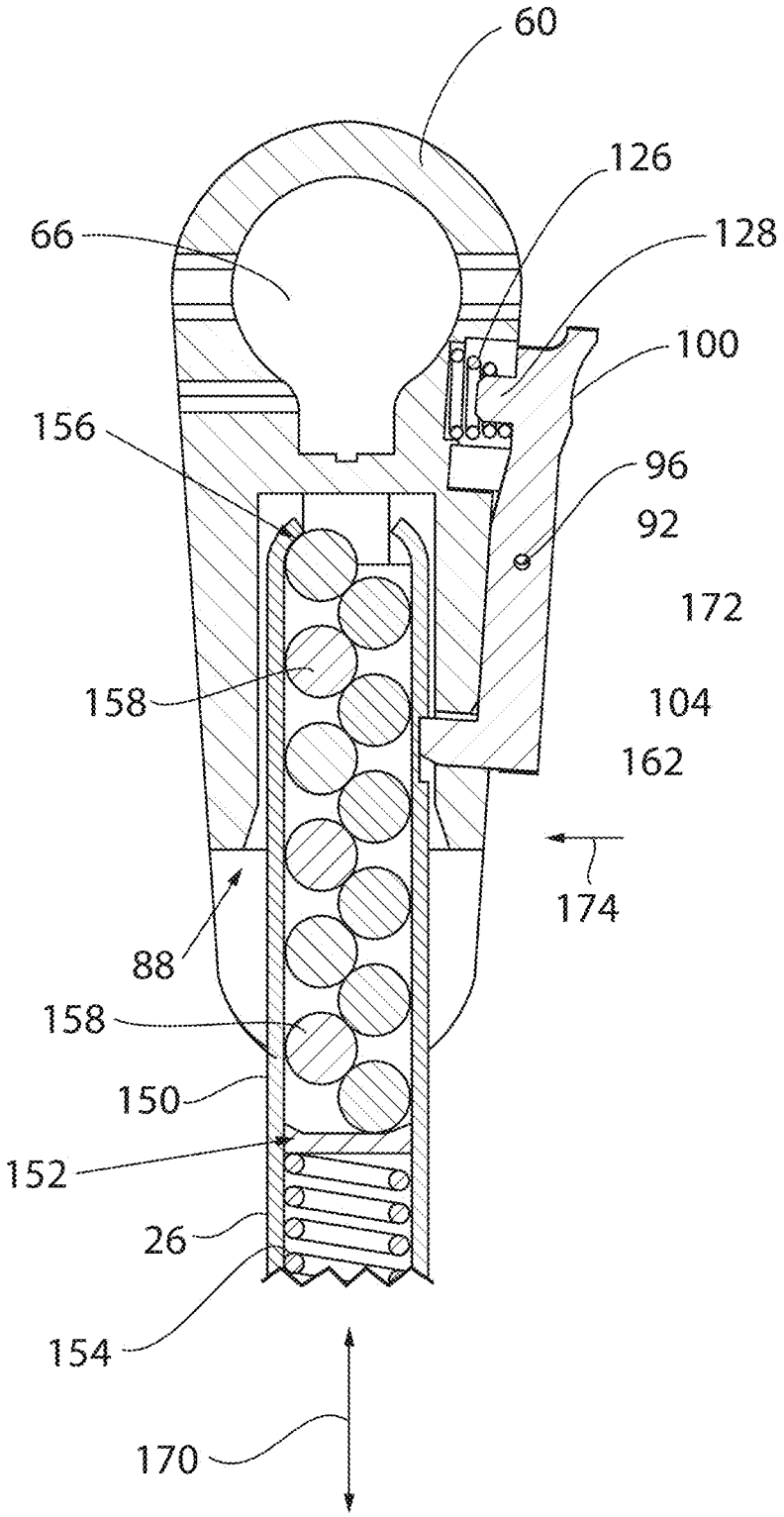
FIG. 6 is a elevational cross section view of the shoulder stock assembly taken along line 6-6 shown in FIG. 3 with a cartridge magazine engaged therewith and with a magazine catch shown in an engaged or secure orientation.
Figure 7:
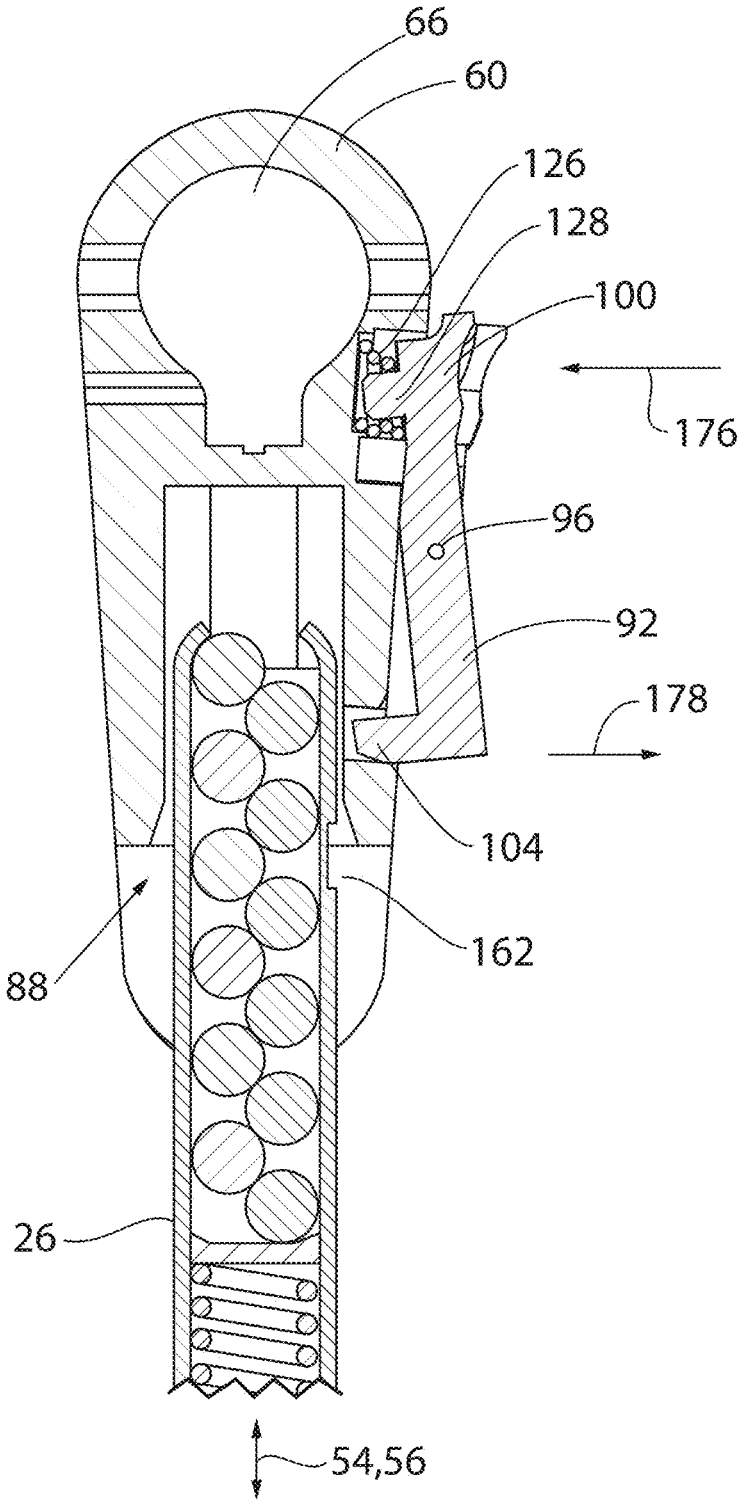
FIG. 7 is a view of the shoulder stock assembly similar to FIG. 6 of the magazine catch shown in a released or disengage orientation.

Referring to FIGS. 6 and 7, supplemental magazines 24, 26—whether fully or partially loaded or unloaded; can be selectively engaged or disengaged from respective stock magazine wells 86, 88 in the same manner as, as shown in FIG. 1, magazine 50 cooperates with receiver magazine well 48. Each of magazines 24, 26, 50 is generally defined by a wall 150 that encloses a slidable pressure plate 152 and a biasing device such as a pressure spring 154 that is configured to bias pressure plate 152 toward an open end 156 defined by the respective magazine assembly. When present, one or more cartridges 158 are captured in a generally stacked orientation within the confines of wall 150 and pressure plate 152 of each discrete magazine assembly. A cavity 162 is formed in wall 150 and oriented to be generally aligned with projection 104 defined by the respective magazine catch 90, 92 when a respective magazine 26, 28, 50 is engaged with the respective stock magazine well 86, 88.

During placement, generally upward translation, indicated by arrow 170, of respective magazine 24, 26, 50 relative to a respective magazine well 86, 88 deflects projection 104 associated with magazine catch 90, 92 in an outward lateral direction, indicated by arrow 172, until projection 104 overlies a cavity 162 associated with a respective magazine 24, 26, 50. When a restrained orientation is attained, projection 104 translates in an inward lateral direction, indicated by arrow 174, under the bias of spring 126 and into secure engagement with the respective magazine 24, 26 associated with the respective stock magazine well 86, 88 thereby securing the respective magazine relative to stock body 60. Referring to FIG. 7, when extraction of a respective magazine 24, 26, 50 from our respective stock magazine well 86, 88 is desired, depression of paddle 100 associated with respective magazine catch 90, 92 in a generally inward lateral direction, indicated by arrow 176, effectuates outward lateral translation, indicated by arrow 178, of projection 104 relative to cavity 162 of the corresponding magazine 24, 26, 50 such that the corresponding magazine 24, 26, 50 drops freely and/or can be manually removed from the respective stock magazine well 86, 88 associated therewith.

When loaded and/or partially loaded, the respective magazine 24, 26, 50 removed from stock body 60 can be subsequently associated with an empty receiver magazine well 48 associated with firearm assembly 22 to effectuate subsequent and/or continued operation thereof. Accordingly, a firearm assembly 22 equipped with shoulder stock assembly 20 according to the present invention provides a firearm supported supplemental magazine capacity wherein a plurality of respective magazines can be securely supported by the underlying firearm and stock assembly and can be intuitively associated and dissociated from receiver magazine well 48 and/or stock assembly receiver wells 86, 88 in accordance with the user's preferences and/or needs. Supplemental magazine wells 86, 88 associated with stock assembly 20 further provide a convenient and intuitive methodology associated with retention and containment of spent or otherwise empty cartridge magazines for subsequent reloading and continued use thereof.

Therefore, one embodiment of the present invention that is usable or combinable with one or more of the features, aspects, objects, or embodiments of the invention disclosed above includes an adjustable firearm butt stock that is constructed to be secured to a rearward facing end of a firearm receiver assembly. The butt stock defines a plurality of magazine wells that are offset from one another along a longitudinal axis of the stock. Each magazine well opens in a generally downward facing direction and is constructed to removeably cooperate with cartridge magazines that removeably cooperate with the receiver magazine well associated with operation of an underlying firearm. The stock includes discrete magazine catches associated with each of the respective stock magazine wells and which are operable to selectively secure and/or effectuate storage and/or removal of discrete cartridge magazines from a respective one of the first and second magazine wells defined by the butt stock.

Another embodiment of the invention that is usable or combinable with one or more of the features, aspects, objects, or embodiments of the invention disclosed above includes a firearm shoulder stock assembly having a shoulder stock body that is constructed to be connected to a firearm receiver such that the shoulder stock body extends rearward from the firearm receiver when the shoulder stock body is connected thereto. A first magazine well is formed in a downward facing surface of the shoulder stock body between a forward facing end and a rearward facing end thereof. A second magazine well is formed in the downward facing surface of the shoulder stock body between the forward facing end and the rearward facing end of the shoulder stock body and positioned such that the second magazine well is offset in a longitudinal direction along the shoulder stock body from the first magazine well. Each of the first magazine well and the second magazine well are shaped to removeably cooperate with a cartridge magazine and such that the first magazine well and the second magazine well are aligned with a receiver magazine well defined by a firearm when the shoulder stock body is connected thereto.

A further embodiment of the present invention that is usable or combinable with one or more of the features, aspects, objects, or embodiments of the invention disclosed above includes a firearm butt stock assembly having a stock body, a first magazine well formed in a downward facing surface of the stock body, and a second magazine well that is also formed in the downward facing surface of the stock body such that the first magazine well and the second magazine well are aligned along a longitudinal centerline of the stock body and shaped to slideably receive respective cartridge magazines and such that the first magazine well and second magazine well are aligned with a receiver magazine well when the stock body is connected to a firearm.

Another embodiment of the present invention that is usable or combinable with one or more of the features, aspects, objects, or embodiments of the invention disclosed above included a method of forming a firearm shoulder stock. The method includes forming a stock body that is constructed to be connected to a firearm receiver assembly. A first magazine well and a second magazine well are each formed in the stock body and oriented such that the first magazine well and the second magazine well are offset from one another relative to a longitudinal axis of the stock body and such that the first magazine well and the second magazine well open in a common direction with respect to a receiver magazine well defined by a firearm receiver assembly when the stock body is connected thereto.

It should be understood that the above description, while indicating representative embodiments of the present invention, is given by way of illustration and not of limitation. Many changes and modifications may be made within the scope of the present invention without departing from the spirit thereof, and the invention includes all such modifications. Various additions, modifications, and rearrangements are contemplated as being within the scope of the following claims, which particularly point out and distinctly claim the subject matter regarding as the invention, and it is intended that the following claims cover all such additions, modifications, and rearrangements.

What is claimed is:

1. A firearm shoulder stock assembly comprising:

a shoulder stock body that is defined by a unitary body that is constructed to be connected to a firearm receiver such that the shoulder stock body extends rearward from the firearm receiver when the shoulder stock body is connected thereto;

a first magazine well formed in a downward facing surface and defined by the unitary body of the shoulder stock body between a forward facing end and a rearward facing end thereof;

a second magazine well formed in the downward facing surface and defined by the unitary body of the shoulder stock body between the forward facing end and the rearward facing end of the shoulder stock body, the second magazine well being offset in a longitudinal direction along the unitary body the shoulder stock body from the first magazine well; and each of the first magazine well and the second magazine well being unobstructed and shaped to removeably cooperate with a cartridge magazine such that the respective cartridge magazine extends beyond the respective one of the first magazine well and the second magazine well when engaged therewith and such that the first magazine well and the second magazine well are non-removable from the shoulder stock body and are aligned with a receiver magazine well defined by a firearm when the shoulder stock body is connected thereto.

2. The firearm shoulder stock assembly of claim 1 further comprising a magazine catch associated with each of the first magazine well and the second magazine well and supported by the unitary body of the shoulder stock body.

3. The firearm shoulder stock assembly of claim 2 wherein the magazine catch associated with the first magazine well is independently operable relative to the magazine catch associated with the second magazine well.

4. The firearm should stock assembly of claim 2 further comprising a spring associated with each magazine catch and that is operable to bias the respective magazine catch into engagement with a cartridge magazine when a respective cartridge magazine is engaged with a respective one of the first magazine well and the second magazine well.

5. The firearm shoulder stock assembly of claim 1 further comprising a cavity formed in the forward facing end of the shoulder stock body such that the cavity extends through the shoulder stock body in a crossing direction relative to the first magazine well and second magazine well.

6. The firearm shoulder stock assembly of claim 5 further comprising a catch pivotably attached to the unitary body of the shoulder stock body proximate the cavity and constructed to cooperate with a buffer tube attached to a firearm receiver.

7. The firearm shoulder stock assembly of claim 6 wherein the catch selectively engages a buffer tube at a plurality of discrete positions to alter a position of the shoulder stock assembly relative to a firearm receiver.

8. A firearm butt stock assembly comprising:

a stock body defined by a one-piece body;

a first magazine well formed in a downward facing surface of the stock body;

a second magazine well formed in the downward facing surface of the stock body such that the first magazine well and the second magazine well are each inseparable from the one-piece body of the stock body and are aligned along a longitudinal centerline of the stock body and shaped to slideably receive respective cartridge magazines that extend beyond the one-piece body of the stock body when engaged therewith and such that the first magazine well and second magazine well are unobstructed and are aligned with a receiver magazine well when the stock body is connected to a firearm.

9. The firearm butt stock assembly of claim 8 further comprising a first magazine catch associated with the first magazine well and a second magazine catch associated with the second magazine well and wherein each of the first magazine catch and the second magazine are slidably associated with the one-piece body of the stock body.

10. The firearm butt stock assembly of claim 9 wherein the first magazine catch and the second magazine catch are independently operable.

11. The firearm butt stock assembly of claim 9 further comprising a first spring constructed to bias the first magazine catch into engagement with a cartridge magazine associated with the first magazine well and a second spring constructed to bias the second magazine catch into engagement with a cartridge magazine associated with the second magazine well.

12. The firearm butt stock assembly of claim 8 further comprising a buffer tube pocket formed in a forward facing end of the one-piece body of the stock body.

13. The firearm butt stock assembly of claim 8 further comprising a buffer tube catch attached to a forward facing end of the stock body and constructed to secure the stock body to a buffer tube at a plurality of positions.

14. The firearm butt stock assembly of claim 8 further comprising a first cartridge magazine that removably cooperates with each of the first magazine well and the second magazine well and a second cartridge magazine that removably cooperates with each of the first magazine well and the second magazine well, the first cartridge magazine and the second cartridge magazine each extending beyond a respective one of the first magazine well and the second magazine well when engaged therewith.

15. A method of forming a firearm shoulder stock, the method comprising:

forming a stock body constructed to be connected to a firearm receiver assembly;

forming a first magazine well in the stock body; and forming a second magazine well in the stock body such that the first magazine well and the second magazine well are each defined by the stock body, are inseparable from the stock body, are unobstructed, and are offset from one another relative to a longitudinal axis of the stock body and such that the first magazine well and the second magazine well open in a common direction with respect to a receiver magazine well defined by a firearm receiver assembly when the stock body is connected thereto.

16. The method of claim 15 further comprising providing a magazine release associated with each of the first magazine well and the second magazine well.

17. The method of claim 15 further comprising forming the stock body to slideably cooperate with a buffer tube associated with a firearm receiver assembly.

18. The method of claim 17 further comprising providing an adjuster that is supported by the stock body and which cooperates the buffer tube to adjust a longitudinal position of the stock body relative to the buffer tube when engaged therewith.

19. The method of claim 15 further comprising forming a pad associated with a rearward facing end of stock body.

20. The method of claim 15 further comprising further providing at least one cartridge magazine that removeably cooperates with either of the first magazine well and the second magazine well such that the at least one cartridge magazine extends beyond the stock body when engaged with either one of the first magazine well and the second magazine well.

* * * * *